US007055937B2

(12) United States Patent
Suzuki et al.

(10) Patent No.: US 7,055,937 B2
(45) Date of Patent: Jun. 6, 2006

(54) HEAT GENERATING RESISTANT ELEMENT FILM, SUBSTRATE FOR INK JET HEAD UTILIZING THE SAME, INK JET HEAD AND INK JET APPARATUS

(75) Inventors: Hiroyuki Suzuki, Kanagawa (JP); Yukihiro Hayakawa, Kanagawa (JP); Yoshinori Kawasaki, Kanagawa (JP); Ichiro Saito, Kanagawa (JP); Sakai Yokoyama, Kanagawa (JP); Toshiyasu Sakai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 10/745,607

(22) Filed: Dec. 29, 2003

(65) Prior Publication Data

US 2004/0179084 A1 Sep. 16, 2004

(30) Foreign Application Priority Data

Dec. 27, 2002 (JP) ..... 2002-380582
Dec. 25, 2003 (JP) ..... 2003-431219

(51) Int. Cl.
*B41J 2/05* (2006.01)

(52) U.S. Cl. ..... 347/62

(58) Field of Classification Search ..... 347/204, 347/61, 62

See application file for complete search history.

(56) References Cited

U.S. PATENT DOCUMENTS

| | | | | |
|---|---|---|---|---|
| 4,392,992 | A | 7/1983 | Paulson et al. | 252/512 |
| 4,429,321 | A | 1/1984 | Matsumoto | 346/140 R |
| 4,510,178 | A | 4/1985 | Paulson et al. | 427/94 |
| 4,591,821 | A | 5/1986 | Paulson et al. | 338/308 |
| 4,723,129 | A | 2/1988 | Endo et al. | 346/1.1 |
| 4,740,796 | A | 4/1988 | Endo et al. | 346/1.1 |
| 4,907,015 | A * | 3/1990 | Kaneko et al. | 347/204 |
| 5,066,963 | A | 11/1991 | Kimura et al. | 346/140 |
| 5,503,878 | A | 4/1996 | Suzuki et al. | 427/539 |
| 6,287,933 | B1 | 9/2001 | Iida et al. | 438/382 |
| 6,336,713 | B1 | 1/2002 | Regan et al. | 347/62 |
| 6,527,813 | B1 * | 3/2003 | Saito et al. | 347/62 |
| 6,530,650 | B1 | 3/2003 | Ozaki et al. | 347/64 |
| 6,663,228 | B1 | 12/2003 | Saito et al. | 347/64 |

FOREIGN PATENT DOCUMENTS

JP 10-114071 5/1998

* cited by examiner

*Primary Examiner*—Huan Tran
(74) *Attorney, Agent, or Firm*—Fitzpatrick, Cella, Harper & Scinto

(57) ABSTRACT

The invention provides a heat generating resistant element having a high durability and a high resistance suitable for constituting an electrothermal converting member in an ink jet head or an ink jet apparatus. There is employed, as the heat generating resistant element, a film constituted of Cr, Si and N, having a composition of Cr: 15 to 20 at. %, Si: 40 to 60 at. % and N: 20 to 45 at. %, which constitute 100 at. % or substantially 100 at. %.

6 Claims, 8 Drawing Sheets

HEAT GENERATING RESISTANT ELEMENT FILM, SUBSTRATE FOR INK JET HEAD UTILIZING THE SAME, INK JET HEAD AND INK JET APPARATUS

BACKGROUND OF THE INVENTION

1. Field of the Invention

The present invention relates to a heat generating resistant element film adapted for constituting an electrothermal converting member as generating means for discharging thermal energy for an ink jet apparatus, which discharges ink by an ink jet method for recording or printing a character, a symbol, or an image onto a recording medium constituted of a paper, a plastic sheet, a cloth or another article, an ink jet head substrate and an ink jet apparatus utilizing an electrothermal converting member utilizing such heat generating resistant element film, and a producing method therefor.

2. Related Background Art

An ink jet apparatus has a configuration for discharging a functional liquid for recording etc. (hereinafter representatively called "ink") from a discharge port onto a recording medium thereby executing a recording of a character, a symbol, an image etc., or an application of a component contained in the ink onto various surfaces, and has a feature capable of a high-speed recording of a high-definition image by discharging the ink as a small liquid droplet from the discharge port at a high speed. In particular, an ink jet apparatus of a type utilizing an electrothermal converting member as energy generation means for generating an energy to be utilized for ink discharge, and executing the ink discharge utilizing a bubble generation in the ink by the thermal energy generated by such electrothermal converting member, is recently attracting attention as it is adapted for achieving a higher definition in the image, a higher speed in recording, a compactization of a recording head and an apparatus, and a color capability (for example, U.S. Pat. No. 4,723,129 and U.S. Pat. No. 4,740,796.

A general configuration of a principal part of a heat substrate to be used in constructing an ink jet apparatus is shown in FIG. 1. FIG. 2 is a schematic cross-sectional view of a substrate 2000 for an ink jet recording head, along a line 2—2 in a portion corresponding to an ink flow path shown in FIG. 1.

The ink jet recording head shown in FIG. 1 is provided with plural discharge ports 1001, and an electrothermal converting member 1002 for generating thermal energy to be utilized for discharging ink from each discharge port is provided for each ink flow path 1003 on a substrate 1004. The electrothermal converting member 1002 is at least constituted of a heat generating resistant element 1005, and a pair of electrodes 1006 connected thereto for an electric power supply thereto, and, in the apparatus shown in FIG. 1, there is provided an insulation film 1007 as a protective layer for at least covering a portion constituting a heat action surface to the ink in the upper part of the heat generating resistant element 1005.

Also each ink flow path 1003 is formed by adjoining a top plate integrally bearing plural flow path walls 1008 under a relative alignment with the electrothermal converting members etc., on the substrate 1004, for example, by image processing. Each ink flow path 1003 communicates, at an end opposite to the discharge port 1001 thereof, with a common liquid chamber 1009, which stores ink supplied from an ink tank. (not shown).

The ink supplied to the common liquid chamber 1009 is guided therefrom to each ink flow path 1003, and is retained therein by forming a meniscus in the vicinity of the discharge port 1001. In this state, the electrothermal converting element 1002 is selectively driven to cause rapid heating and boiling, by the thermal energy generated therein, of the ink on the heat action surface, thereby discharging the ink by an impact force in such situation.

As shown in FIG. 2, a substrate portion in the ink jet head is provided, on a silicon substrate 2001, with a structure of a heat accumulation layer 2002 constituted of a thermal oxidation film on the surface of the silicon substrate, an interlayer film 2003 constituted of an SiO film or an SiN film and having also a heat accumulating function, a heat generating resistant element layer 2004, a metal wiring 2005 constituted of an electrode layer of a metal or an alloy such as Al, Al—Si, Al—Cu etc., a protective layer 2006 constituted of a SiO film, a SiN film etc., and an anticavitation film 2007, laminated in this order. The anticavitation film 2007 is provided for protecting the protective film 2006 from chemical and physical impacts resulting from the heat generation of the heat generating resistant element layer 2004, and forms a heat action portion 2008 in a part contacting with the ink. The heat generating resistant element 1005 shown in FIG. 1 is formed by exposing a predetermined portion of the heat generating resistant element layer 2004 between the electrode layers 2005.

The heat generating resistant element to be employed in the recording head of the ink jet apparatus having the aforementioned structure is generally different from the heat generating resistant element employed in a thermal print head.

This is because, in a thermal print head, an electric power of about 1 W within a period of 1 msec is applied to the heat generating resistant element, while, in an ink jet head, an electric power of 3 to 4 W within a period for example of 7 μsec is applied to the heat generating resistant element, in order to gasify the ink within a short time. Since such electric power is several times larger than the electric power applied to the thermal print head, the heat generating resistant element of the ink jet head tends to be subjected to a thermal stress within a shorter time in comparison with that of the thermal print head.

Therefore, in consideration of the discharge and the driving method specific to the ink jet head and different from those in the thermal print head, a matching design (film thickness, heater size, shape etc.) is required for the heat generating resistant element and it is known that the heat generating resistant element employed in the thermal print head is not immediately applicable to the ink jet head.

In the ink jet recording apparatus, a higher functionality such as a higher image quality and a higher recording speed is recently requested increasingly, as explained in the foregoing. Among these requirements, a higher image quality can be achieved by a method of decreasing the size of the heater (heat generating resistant element) thereby reducing a discharge amount per dot and thus reducing the dot size.

Also for achieving a higher recording speed, there can be employed a driving method with a shorter pulse than in the prior drive, thereby increasing the drive frequency.

However, in order to drive the heater with a high frequency in a configuration of a reduced heater size for achieving a higher image quality, it is necessary to increase the sheet resistance.

Now reference is made to FIGS. 3A and 3B for schematically explaining the relationship among various drive conditions as a function of the heater size. FIG. 3A shows a change in a sheet resistance and a current in the heat generating resistant element as a function of a driving pulse width when the heater size is changed from large (A) to small (B) at a constant driving voltage. Also FIG. 3B shows the sheet resistance and the current in the heat generating resistant element as a function of the driving voltage when the heater size is changed at a constant driving pulse width.

As will be apparent from the relationship between the driving conditions and the size of the heat generating resistant element in FIGS. 3A and 3B, it is necessary to increase the sheet resistance in order to employ the same drive conditions as before with a smaller heater size. Also in consideration of the energy, a driving method with an increased sheet resistance and a higher driving voltage reduces a consumed current, thereby decreasing the energy consumption in resistances other than in the heater, thus achieving an energy saving. Such effect becomes particularly conspicuous in a multi-nozzle configuration including a plurality of heat generating resistant elements.

Thus the Japanese Patent Application Laid-Open No. H10-114071 discloses a configuration of constituting a heat generating resistant element of the ink jet head with a thin film of $Ta_xSi_yN_z$ with x=20–80 at. %, y=3–25 at. % and z=10–60 at. % thereby enabling a heat generating resistance property of a high resistance adapted for a small dot and realizing an energy saving when applied to an ink jet recording head.

Among the properties required for the heat generating resistant element to be employed in the ink jet head, in addition to a high resistance, a durability is also an important property to be satisfied at the same time.

The resistor in the ink jet head repeats heat generation by a high frequency electric power of short pulses, and a bubble is generated in the ink according to the cycles of the heat generation, thereby discharging the ink. In such state, the heat generating resistant element reaches a temperature of 600 to 700° C., and an eventual change in the resistance of the resistor in such repetition between the room temperature and the high temperature poses a serious problem in the ink discharge.

More specifically, as the ink jet head is generally driven by a constant voltage drive, a trouble is induced in case the resistance shows a large change during the drive.

For example, a decrease in the resistance significantly reduces the service life of the resistor by an excessive current, while an increase in the resistance reduces the current, eventually failing the ink discharge.

It is therefore necessary, as the durability characteristics of the resistor, that the resistor shows a minimal change in resistance even after the temperature hysteresis actually experienced by the resistor. Such durability can be predicted to a certain extent by an evaluation of a temperature coefficient of resistance (TCR characteristics) of the material.

It is known that the durability is generally better when the TCR characteristics of the resistor is very small (ideally zero). In developing a material for the resistor, it is important to simultaneously realize a high resistance and the durability characteristics. The aforementioned patent reference describes that preferable TCR characteristics can be achieved by selecting a specific resistivity at 2,500 μΩ·cm or less.

However, in the recent trend toward the higher image quality, emphasis is given to the substantial elimination of granularity, and, for this purpose, there is desired a discharge amount of the liquid droplet not exceeding 1 pl.

For achieving the ink discharge with a high driving frequency and with multiple nozzles at a discharge amount of 1 pl or less to be requested hereafter, a sheet resistance of 700 Ω/□ or higher is considered necessary, for example, for a drive voltage of 24 V, a pulse width of 1 μs, and a heater size of 17×17 μm in order to suppress a temperature increase in the head and to stabilize the discharge without decreasing the driving voltage.

However, with respect to TaSiN, the aforementioned patent reference discloses to select the specific resistivity of 2,500 μΩ·cm or less in order to obtain preferable TCR characteristics. Stated differently, in case the aforementioned TaSiN is used to attain the recently requested sheet resistance of 700 Ω/□ or higher (corresponding to specific resistivity of 3,000 μΩ·cm or higher), there will result inferior TCR characteristics and an insufficient durability.

Also in case the resistance is elevated in this manner, there also results a difficulty in productivity such as a fluctuation in the specific resistivity.

For this reason, it has become necessary to find a novel material capable of satisfying a higher resistance and a durability. The novel material is also required to be capable of providing a sufficient margin in productivity.

As a material capable of providing the aforementioned sheet resistance, Japanese Patent Publication No. H2-18651, U.S. Pat. No. 4,392,992, U.S. Pat. No. 4,510,178, U.S. Pat. No. 4,591,821 etc., disclose compositions of a CrSiN film. However, these references do not teach nor suggest at all as to which atomic composition of CrSiN film is useful as a heat generating resistant element for the electrothermal converting member of the ink jet head, and a composition capable of also satisfying the durability has not been known at all.

SUMMARY OF THE INVENTION

A principal object of the present invention is to solve aforementioned drawbacks associated with the conventional material for the heat generating resistant element of the ink jet recording head, and to provide a heat generating resistant element film adapted for use as a heat generating resistant element allowing to obtain a recorded image of a high quality over a prolonged period and a producing method therefor. Another object of the present invention is to provide an ink jet apparatus having, as a heat generating resistant element of an electrothermal converting member, a heat generating resistant element film enabling a stable ink discharge even in case of a smaller dot discharge for realizing a recorded image of a higher definition or a high-speed drive for realizing a high-speed recording, an ink jet head substrate to be employed in such configuration and a producing method therefor.

A heat generating resistant element film of the present invention is characterized in being constituted of Cr, Si and N with a following composition:

Cr: 15 to 20 at. %,
Si: 40 to 60 at. % and
N: 20 to 45 at. % which constitute 100 at. % or substantially 100 at. %.

For such heat generating resistant element film, there is preferred a film formed by reactive sputtering, employing a CrSi alloy as a target in a mixed gas atmosphere including nitrogen gas and argon gas.

An ink jet head substrate of the present invention, constituted of a substrate bearing an electrothermal converting member having a heat generator resistor for generating, by a current supply, thermal energy to be utilized for ink discharge, is characterized in that the heat generating resistant element is a heat generating resistant element film constituted of Cr, Si and N with a following composition:

Cr: 15 to 20 at. %,
Si: 40 to 60 at. % and
N: 20 to 45 at. % which constitute 100 at. % or substantially 100 at. %.

In such substrate, the heat generating resistant element film preferably has a thickness within a range from 300 to 8.00 Å. Also the aforementioned electrothermal converging member can have a configuration including a pair of electrodes for current supply to the heat generating resistant element member. The substrate also includes a heat action surface for causing the thermal energy to act on ink, and such heat action surface is preferably constituted of a protective layer covering the heat generating resistant element. There may also be assumed a configuration including a plurality of the heat generating resistant elements. Further, in the substrate, the heat generating resistant element film is preferably formed by a reactive sputtering, employing a CrSi alloy as a target in a mixed gas atmosphere including nitrogen gas and argon gas.

In another embodiment of the present invention, an ink jet head including an ink discharge port for discharging ink, an ink flow path communicating with the ink discharge port and having a heat action surface for causing thermal energy, to be utilized for ink discharge from the ink discharge port, to act on the ink, and an electrothermal converting member having a heat generating resistant element for generating the thermal energy by a current supply, is characterized in that the heat generating resistant element is a heat generating resistant element film constituted of Cr, Si and N with a following composition:

Cr: 15 to 20 at. %,
Si: 40 to 60 at. % and
N: 20 to 45 at. % which constitute 100 at. % or substantially 100 at. %.

An ink jet apparatus of the present invention, including an ink jet head for discharging ink, and means which provides the ink jet head with a recording signal, is characterized in that the ink jet head has the aforementioned configuration.

Such apparatus can have a configuration provided with a carriage for mounting the aforementioned ink jet head, and can employ a heat generating resistant element film therein formed by a reactive sputtering, employing a CrSi alloy as a target in a mixed gas atmosphere including nitrogen gas and argon gas.

A producing method for the heat generating resistant element film of the aforementioned composition of the present invention is characterized in forming, on a predetermined surface of a substrate, the heat generating resistant element film by a reactive sputtering, employing a CrSi alloy as a target in a mixed gas atmosphere including nitrogen gas and argon gas. The method may further include, after the film forming step, a heat treatment step for the film.

A producing method for the ink jet head substrate of the present invention is a method for producing the ink jet head substrate of the aforementioned configuration, characterized in including a step of forming the heat generating resistant element film by a reactive sputtering, employing a CrSi alloy as a target in a mixed gas atmosphere including nitrogen gas and argon gas. Also this method may further include, after the film forming step, a heat treatment step for the film.

A producing method for the ink jet apparatus of the present invention is a method for producing an ink jet apparatus of the aforementioned configuration, characterized in including a step of forming the heat generating resistant element film by a reactive sputtering, employing a CrSi alloy as a target in a mixed gas atmosphere including nitrogen gas and argon gas. Also this method may further include, after the film forming step, a heat treatment step for the film.

A CrSi-based material is already known as a material for constituting the heat generating resistant element for the thermal head, but there has not been obtained a knowledge as to which elementary configuration and atom number composition of such material provide a heat generating resistant element adequate for the electrothermal converting member of the ink jet head capable of attaining the objects of the present invention. The present inventors have obtained a new knowledge that the aforementioned objects of the present invention can be attained by adding N as an elementary component to Cr and Si, and adopting the aforementioned specified atomic number composition, thereby having made the present invention.

According to the present invention, there can be provided a heat generating resistant element film as a material for the heat generating resistant element, which has an excellent thermal response in a drive utilizing a relatively short pulse, is capable of providing a high sheet resistance and is adapted for a further miniaturization of the heater size. Also by employing such heat generating resistant element film in a heat generating resistant element of the electrothermal converting member, it is possible to provide an ink jet apparatus, an ink jet head to be employed therein and a substrate for constituting such ink jet head, capable of enabling stable ink discharge even in case of a smaller dot for a higher definition of the recorded image or a high-speed drive for a high-speed recording, and reducing the electric current consumption in the drive thereby contributing to energy saving.

As explained in the foregoing, a heat generating resistant element film of the present invention, particularly a plurality of heat generating resistant element for generating thermal energy to be utilized for ink discharge, is constituted of a film of a material represented by CrSiN, having a composition of Cr: 15 to 20 at. %, Si: 40 to 60 at. % and N: 20 to 45 at. %.

The heat generating resistant element of the ink jet recording head of the present invention can maintain desired durability even in case of a drive with a short pulse, thereby providing a recorded image of a high quality over a prolonged period. Positive and very small TCR characteristics are considered to significantly contribute to such performance.

The ink jet recording head of the present invention provides effects of enabling a heat generating resistance property of a high resistance suitable for a smaller dot, and realizing a high energy efficiency thereby suppressing the heat generation and enabling energy saving.

DESCRIPTION OF THE PREFERRED EMBODIMENTS

Figure 1:
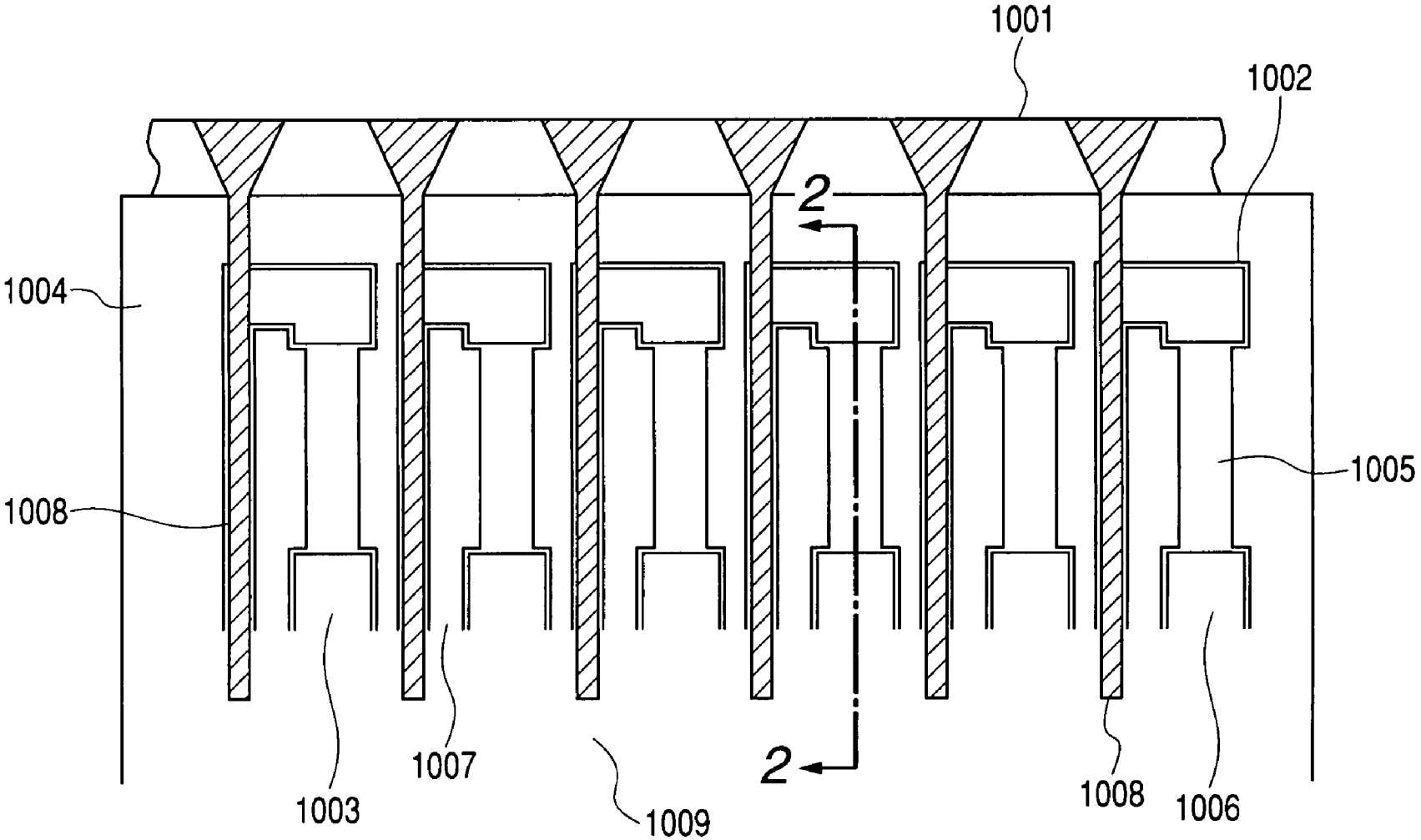
FIG. 1 is a schematic plan view showing a substrate for an ink jet head.

A heat generating resistant element film of the present invention is constituted of Cr, Si and N with a following composition:

Cr: 15 to 20 at. %,
Si: 40 to 60 at. % and
N.: 20 to 45 at. % which constitute 100 at. %.

The heat generating resistant element film may also include, within an extent that the desired characteristics are not affected, an element of a trace amount other than the aforementioned elements, namely may be a film in which a sum of Cr, Si and N is substantially 100 at. %. For example, a proportion of the summed number of atoms (Cr+Si+N) in the total number of atoms constituting the material is preferably 99.5 at. % or higher and more preferably 99.9 at. % or higher.

More specifically, a surface or an interior of the film may be oxidized or may incorporate a gas in a reaction area upon exposure to the air or in the course of preparation, for example, by sputtering, but the effect is not deteriorated by such slight oxidation or fetching of gas such as Ar on the surface or in the interior. Examples of such impurity includes Ar and at least one element selected from O, C, Si, B, Na and Cl.

The heat generating resistant element film of the present invention is more preferably constituted of Cr, Si and N with a following composition:

Cr: 17 to 20 at. %,
Si: 42 to 55 at. % and
N: 28 to 40 at. % which constitute 100 at. %, or substantially 100 at. %.

In case of use as a heat generating resistant element of an electrothermal converting member of an ink jet head, the heat generating resistant element film preferably has a thickness from 200 to 1,000 Å, more preferably 300 to 800 Å.

The heat generating resistant element film, having the composition defined by the aforementioned atomic %, shows a significantly improved sheet resistance, and can secure a satisfactory stability in drive, when employed as a heat generating resistant element of the electrothermal converting member of the ink jet head. The heat generating resistant element film having the aforementioned composition can provide, because of a high sheet resistance, a satisfactory drive state with a given power consumption, particularly with a smaller current, and has advantageous characteristics in the standpoints of energy saving and application to a compact ink jet apparatus employing a battery of a small current. Also it is improved in a response to an input signal (discharge instruction signal) to the electrothermal converting member, thereby stably obtaining a bubble generating state necessary for the discharge.

The heat generating resistant element film of the aforementioned composition can be utilized for constituting an ink jet head and a substrate to be used therein, and can further provide an ink jet apparatus utilizing these.

An example of the configuration of such ink jet head includes a configuration explained above by FIGS. 1 and 2. In the ink jet head substrate of the present invention and the ink jet head substrate utilizing the same, the heat generating resistant element film of the aforementioned composition is employed in the heat generating resistant element layer 2004 shown in FIG. 2.

The ink jet head substrate has a basic configuration having a protective layer on a heat generating resistant element. In such case, though the heat conducting efficiency to the ink is somewhat lost, there can be obtained an ink jet head further improved in the durability of the electrothermal converting member and in the resistance change in the heat generating resistant element by an electrochemical reaction. Based on such standpoint, the protective layer is preferably has a total thickness within a range of 1,000 Å to 5 μm. A preferred example of the protective layer is constituted of an Si-containing insulation layer such as of $SiO_2$ or SiN provided on the heat generating resistant element and a Ta layer so provided on such layer as to form a heat action surface.

The ink jet head substrate of the present invention at least includes a configuration provided, on a substrate, with an electrothermal converting member having a heat generating resistant element for generating, by a current supply, thermal energy to be utilized for ink discharge, and further includes at least either of a pair of electrodes connected to the heat generating resistant element and a protective layer covering at least the heat generating resistant element.

Figure 2:
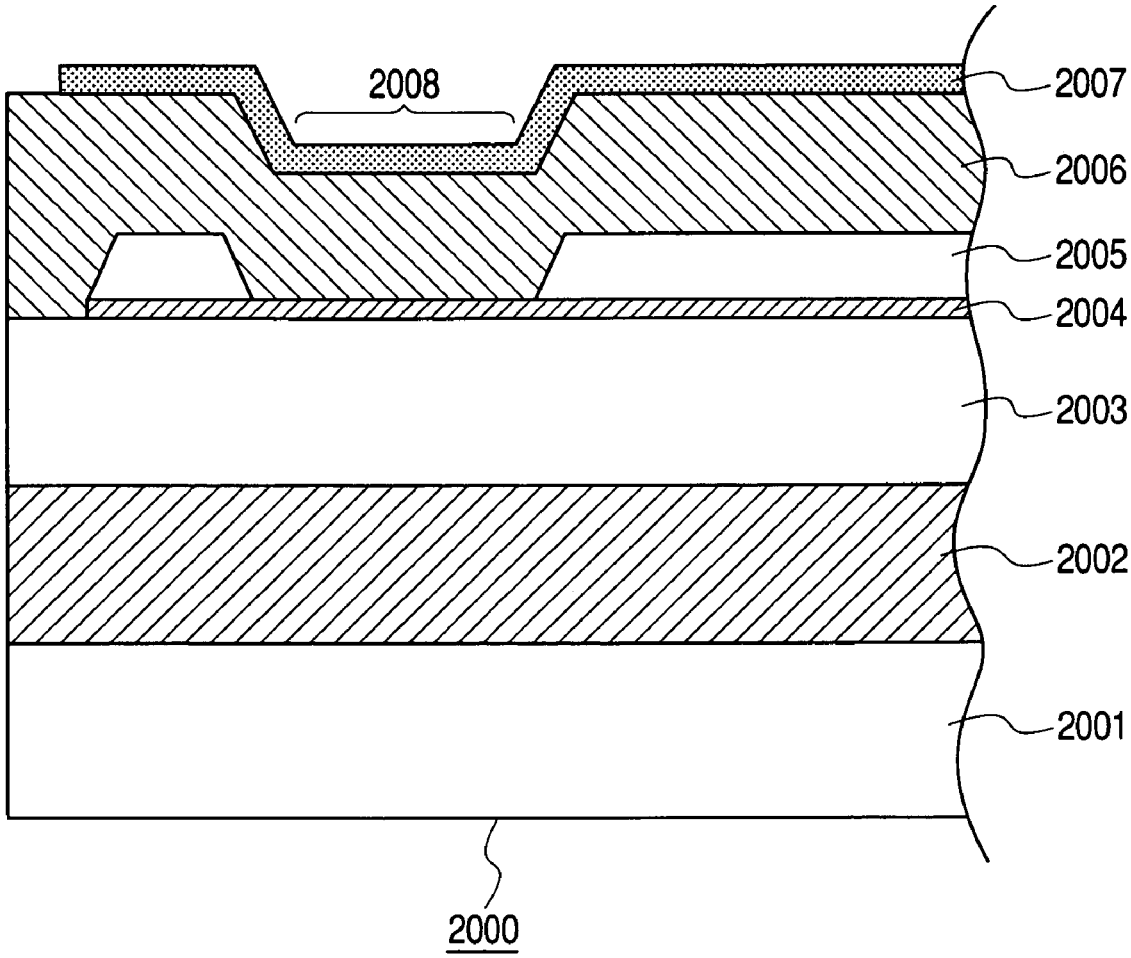
FIG. 2 is a vertical cross-sectional view of the substrate along a chain line 2—2 in FIG. 1.
Figure 3A:
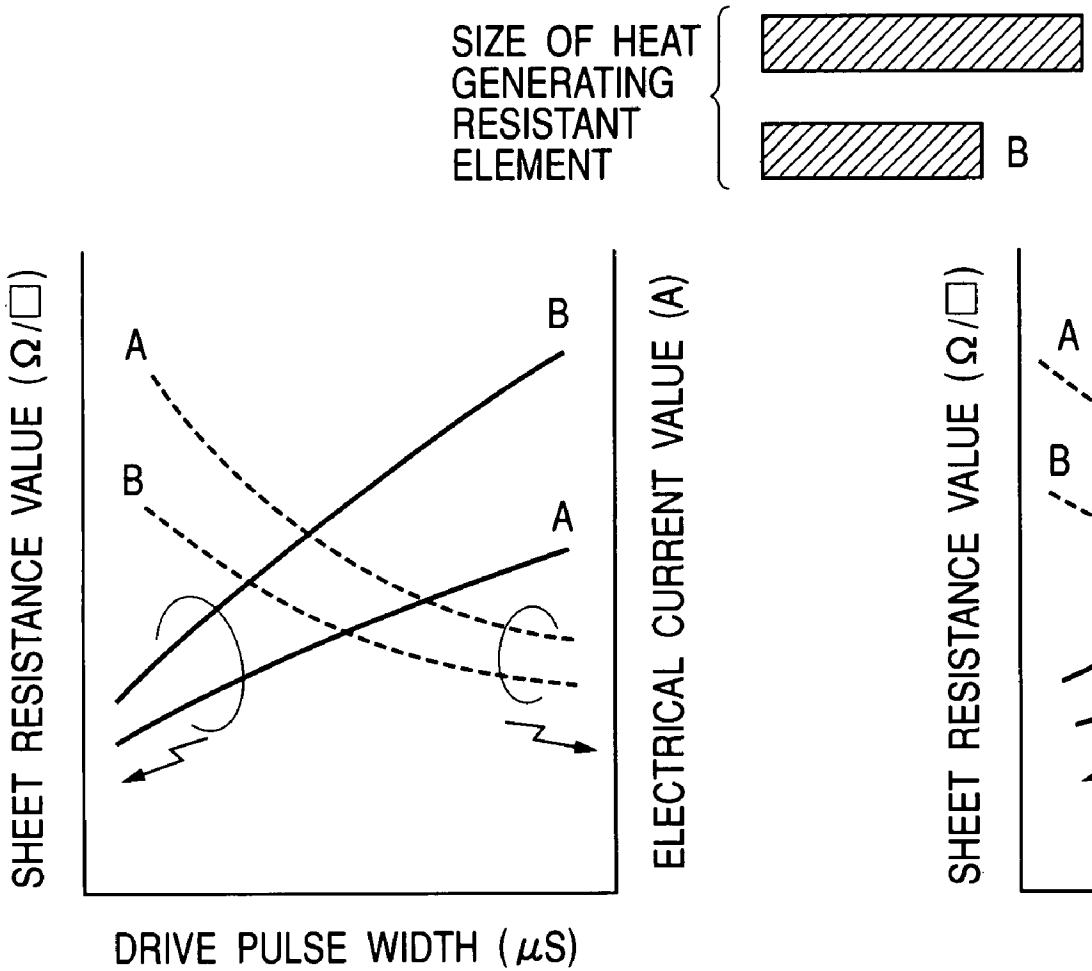
FIGS. 3A and 3B are charts showing various drive conditions in different heater sizes.
Figure 3B:
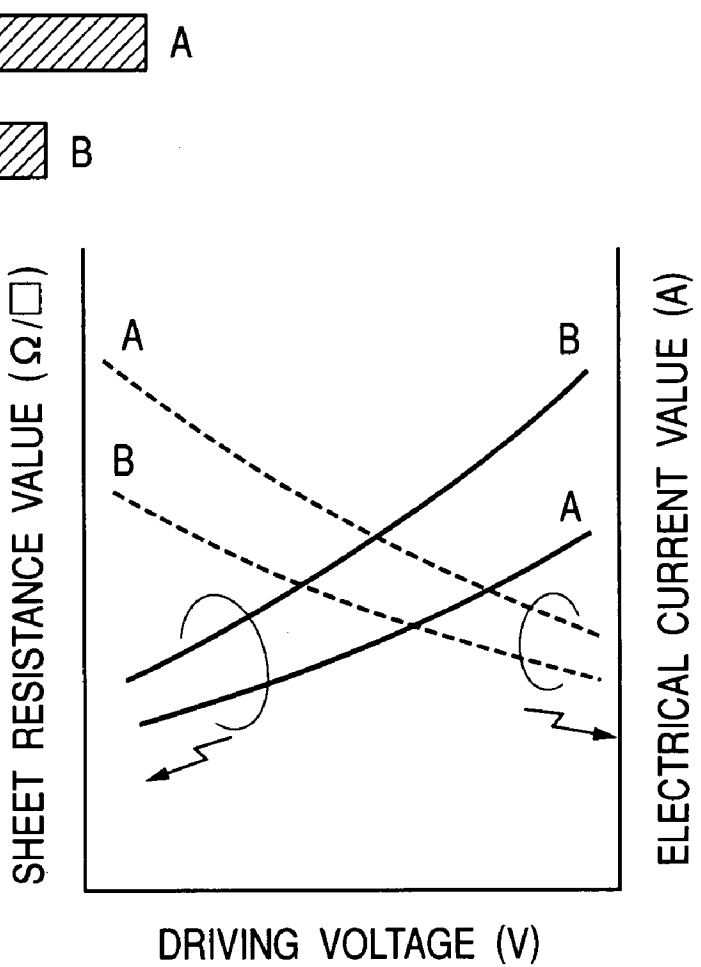

In the configuration shown in FIG. 2, the electrode layer 2005 is laminated on the heat generating resistant element layer 2004 and an electrothermal converting member is constituted by forming an exposed portion of the heat generating resistant element layer 2004 between a pair of opposed end portions of the electrode layer 2005, and the heat generating resistant element layer constituting such exposed portion has a function as a resistor member. The positional relationship of the heat generating resistant element layer and the electrode layer may be such that the end portions of the electrode layer are positioned under the heat generating resistant element layer.

An ink jet head can be obtained by forming at least an ink flow path as shown in FIG. 1 in a position corresponding to each heat action surface of the substrate shown in FIG. 2. The ink flow path can be formed with a material and a method already known.

Figure 7A:
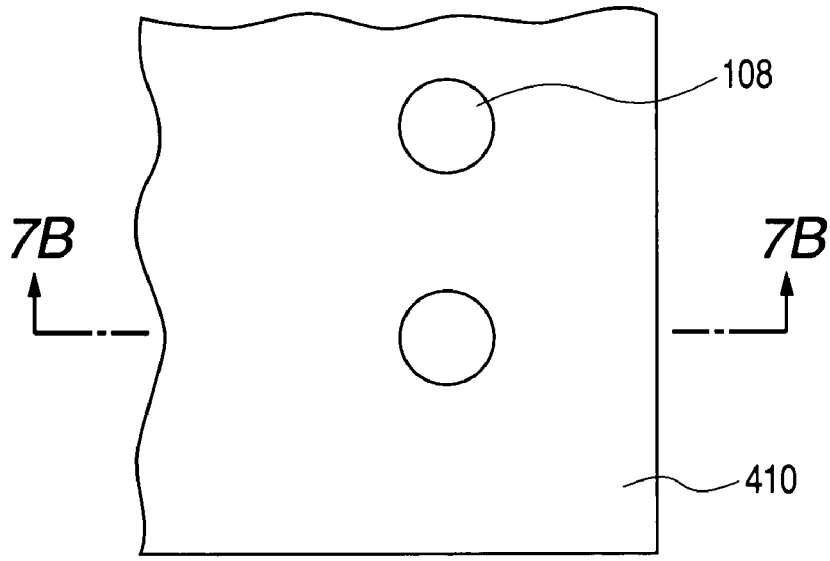
FIGS. 7A and 7B are views showing another embodiment of the ink jet head.
Figure 7B:
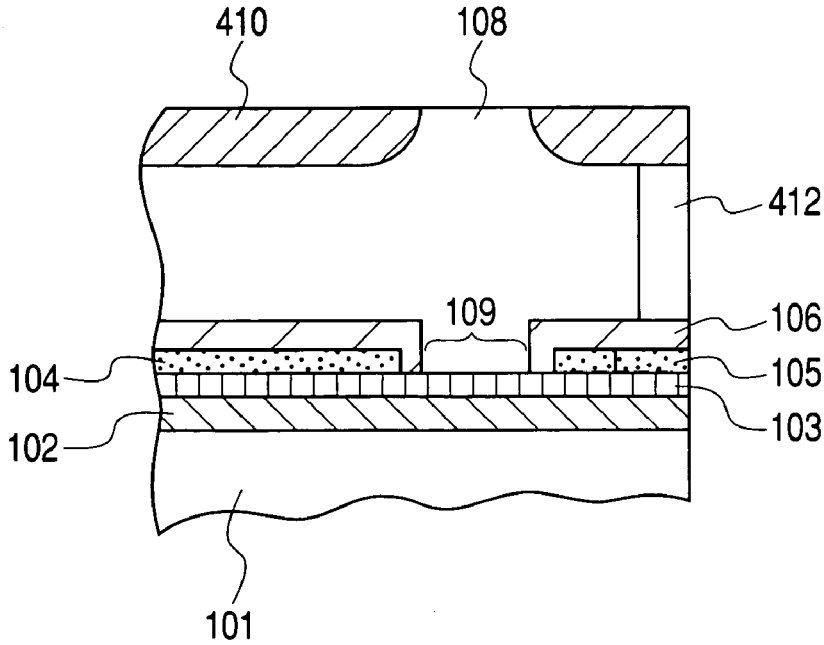

In the configuration shown in FIGS. 1 and 2, the positional relationship of the discharge port and the ink flow path is such that an ink supply direction in the ink flow path and an ink discharge direction from the discharge port substantially coincide, but the ink jet head of the present invention is not limited to such configuration and there may also be assumed a configuration, for example, as shown in FIGS. 7A and 7B, in which an orifice plate 410 supported by a support member 412 and constituting a part (ceiling portion) of the ink flow path is provided with plural discharge ports 108 and a discharge from the discharge port is angled (in a perpendicular direction in the illustrated example) with respect to the ink supply direction to the ink flow path.

The ink jet head of the present invention preferably has a configuration having an ink discharge structural unit, including the discharge port, the ink flow path and the heat generating resistant element, in plural units as shown in FIG. 1. Since the heat generating resistant element film employed in the heat generating resistant element has a high sheet resistance and is suitable for compactization, the present invention is particularly effective in case of arranging the ink discharge units at a high density such as 8 unit/mm or higher, or 12 unit/mm or higher. An example of the configuration having such ink discharge structural unit in plurality is so-called full-line type ink jet head in which the ink discharge structural units are arranged over the entire width of a printing area of a recording material.

In such so-called full-line type ink jet head in which the discharge ports are arranged corresponding to the width the recording area of the recording material, namely an ink jet head having 1,000 or more, particularly 2,000 or more discharge ports, a fluctuation in the resistance in the heat generating portions within a single ink jet head affects the uniformity in the volume of droplets discharged from the discharge ports, thus leading to an unevenness in image density. However, the heat generating resistant element of the present invention is capable of obtaining a desired specific resistivity under satisfactory control and an extremely small fluctuation of the resistance within a single ink jet head, thereby resolving the aforementioned drawback in a significantly improved state.

As explained in the foregoing, the heat generating resistant element of the present invention is meaningful in the recent trend that a higher speed (for example, a print speed of 30 cm/sec or higher, or even 60 cm/sec or higher) and a higher density are requested for the recording and the number of the discharge ports of the ink jet head correspondingly increases.

Also in an ink jet head of a configuration in which a functional element is structurally incorporated in a surface of an ink jet head substrate as disclosed in U.S. Pat. No. 4,429,321, it is one of the important points to form electric circuits of the entire ink jet head exactly as designed thereby facilitating to maintain the function of the functional element in a normal state, and the heat generating resistant element of the present invention is also extremely effective in this point. This is because, as explained in the foregoing, the heat generating resistant element of the present invention is capable of obtaining a desired specific resistivity under satisfactory control and an extremely small fluctuation of the resistance within a single ink jet head, whereby the electric circuits of the entire ink jet head can be formed exactly as designed.

In addition, the heat generating resistant element of the present invention is extremely effective in an ink jet head of a disposable cartridge type in which an ink tank, storing the ink to be supplied to the heat action surface, is integrally provided, in a detachable manner if necessary. The ink jet head of such type is required to realize a low running cost of an entire ink jet apparatus in which such ink jet head is to be mounted, and the heat generating resistant element of the present invention can be so constructed as to come into direct contact with the ink, as explained in the foregoing, to achieve a satisfactory heat transmission efficiency to the ink, thereby reducing the electric power consumption in the entire apparatus and easily meeting the aforementioned requirement.

It may also be utilized not only for generating the thermal energy to be utilized for ink discharge, but also as a heater provided if necessary for heating a desired portion within the ink jet head, and is particularly preferably employed in case such heater comes into direct contact with the ink.

An ink jet recording apparatus capable of high-speed recording and image recording of high image quality can be obtained by mounting the ink jet head of the aforementioned configuration in a main body of the apparatus and providing the ink jet head with a signal from the main body of the apparatus.

Figure 8:
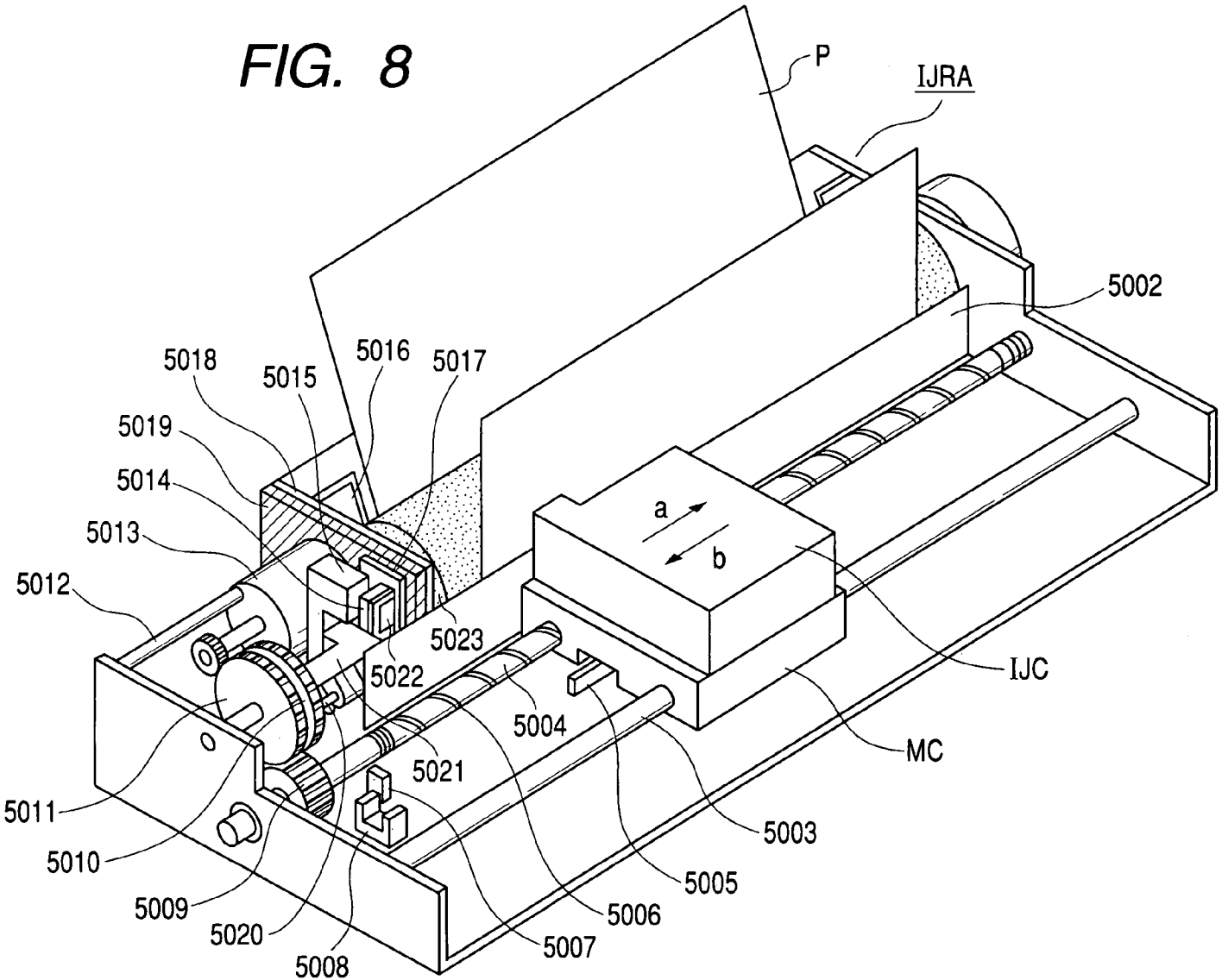
FIG. 8 is a view showing an example of an ink jet apparatus.

FIG. 8 is a schematic perspective view of an example of an ink jet recording apparatus IJRA in which the present invention is applicable. A carriage HC is provided with a pin (not shown) engaging with a spiral groove 5004 of a lead screw 5005 rotated through power transmission gears 5011, 5012 by a forward or reverse rotation of a driving motor 5013, and is reciprocated in directions a, b. A paper pressing plate 5002 presses a paper onto a platen 5000 over the moving direction of the carriage. Photocouplers 5007, 5008 constitute home position detection means for detecting, in this area, presence of a lever 5006 of the carriage, thereby switching the rotating direction of the motor 5013. A member 5016 supports a cap member 5022 for capping the entire surface of an ink jet recording head IJC of a cartridge type integrally including an ink tank, and suction means 5015 for sucking the interior of such cap executes a suction recovery of the ink jet recording head through an aperture 5023 in the cap. A cleaning blade 5017 and a member 5019 for moving the blade in a rear-front direction are supported by a support plate 5018 of the main body. The blade is not limited to such form, and any known cleaning blade may naturally be applied to the present embodiment. A lever 5012 for initiating the suction of the suction recovery is moved by a movement of a cam 5020 engaging with the carriage, and is moved by a driving power of the driving motor through known transmission means such as a clutch. A CPU (not shown) for providing the electrothermal converting member provided in the ink jet head IJC with a signal and for controlling the aforementioned mechanisms is provided in the main body of the apparatus.

In the foregoing, there has been explained an apparatus of a type in which the ink jet head is mounted on the carriage and executes a scanning motion relative to the recording medium, but the ink jet head and the ink jet apparatus of the present invention may also be constructed as an apparatus of pen type in which the ink jet head and the ink tank are integrally constructed. Also the ink jet head may be provided with an ink chamber, for containing the ink to be supplied to the ink flow path, if necessary in common to plural ink flow paths, and a full-color image can be recorded by supplying the ink chambers with inks of respectively different colors, for example, cyan, magenta, yellow and if necessary black colors. Also the ink tank storing the ink may be integrated with the ink jet head as explained before, or detachably connected with the ink jet head. Otherwise, it may be detachably connected, if necessary, to a portion other than the ink jet head of the ink jet apparatus.

In the above-described configurations, portions other than the heat generating resistant element can be formed with materials and methods already known.

The heat generating resistant element film of the present invention can be prepared by various film forming methods as a film having the aforementioned composition and satisfying the predetermined characteristics. Among these methods, there is preferred reactive sputtering, particularly magnetron sputtering employing a high frequency (RF) power supply or a direct current (DC) power supply as the power source.

For example, a heat generating resistant element film can be prepared on a substrate by reactive sputtering employing a CrSi alloy as a target in a mixed gas atmosphere including nitrogen gas and argon gas.

Figure 4:
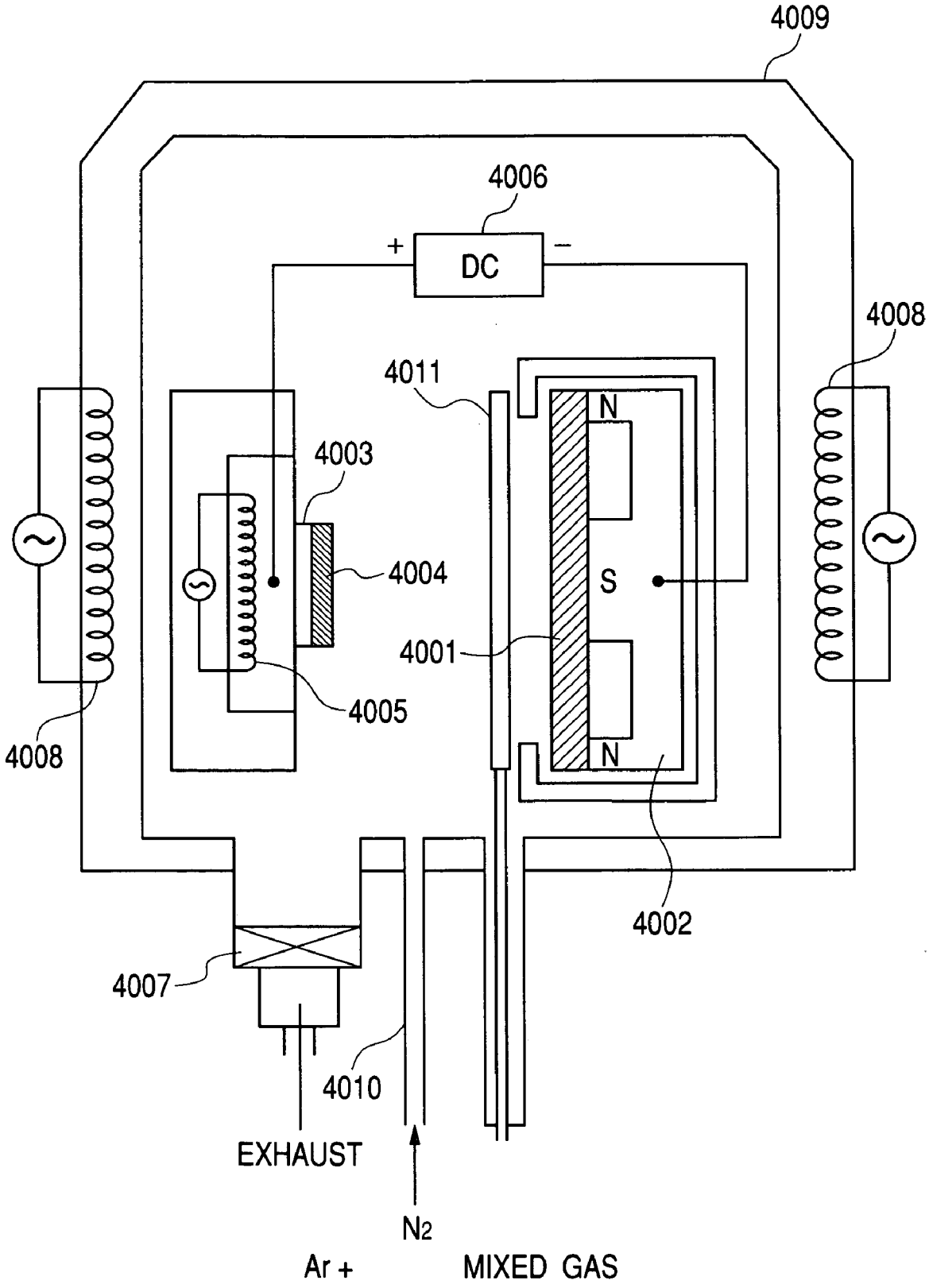
FIG. 4 is a view showing a film forming apparatus for forming layers of the substrate for an ink jet recording head of the present invention.

FIG. 4 schematically shows an example of a film forming apparatus by reactive sputtering.

In FIG. 4, there are shown a Cr—Si target 4001 prepared in a predetermined composition in advance; a flat plate magnet 4002; a shutter 4011 for controlling film formation on a substrate; a substrate holder 4003; a substrate 4004; and a power supply 4006 connected to the target 4001 and the substrate holder 4003. In FIG. 4, there is also shown an external heater 4008 provided surrounding an external peripheral wall of a film forming chamber 4009. The external heater 4008 is used for regulating an atmosphere temperature of the film forming chamber 4009. On a rear surface of the substrate holder 4003, there is provided an internal heater 4005 for controlling the temperature of the substrate. The temperature control of the substrate 4004 is preferably executed in cooperation with the external heater 4008.

A film formation with the apparatus shown in FIG. 4 is executed in a following manner.

At first, with an unrepresented exhaust pump and through an exhaust valve 4007, the film forming chamber 4009 is evacuated to $1\times10^{-5}$ to $1\times10^{-6}$ Pa. Then a mixed gas of argon gas and nitrogen gas is introduced, through a mass flow controller (not shown), into the film forming chamber 4009 through a gas introducing aperture 4010. In this state, the internal heater 4005 and the external heater 4008 are so regulated that the substrate and the atmosphere reach predetermined temperatures.

Then an electric power is applied from the power supply 4006 to the target 4001 to induce a sputtering discharge, and the shutter 4011 is adjusted to form a film on the substrate 4004. Film forming conditions in this operation are so regulated as to obtain the aforementioned composition.

The heat generating resistant element film formed on the substrate is preferably subjected further to a heat treatment. The heat treatment may be executed in the sputtering apparatus in continuation, or as a post step in another apparatus.

This heat treatment generates an intermetallic compound constituted of $CrSi_2$ in CrSiN constituting the heat generating resistant element film, and can achieve a further improvement in the durability because such intermetallic compound is thermally stable and has a small TCR. Based on these facts, the composition ratio of Cr and Si is preferably close to 1:2. It is estimated that the specific resistivity is increased by an inclusion N in such state. The heat generating resistant element constituted of such heat generating resistant element film can provide a desired durability and a high energy efficiency even in case of continuous drive with short pulses and with a small heater size, thereby enabling energy saving by suppressing heat generation and providing a recorded image of a high quality. Thus formed heat generating resistant element film can be shaped by various patterning methods, such as a method of executing a dry etching in a state where a portion to be left is covered with a resist material, thereby eliminating an unnecessary portion from the substrate.

EXAMPLES

In the following embodiments of the present invention will be explained by examples. However, the present invention is not limited to examples to be explained in the following, but is applicable to a resistor film to be utilized for other application as long as the objects of the present invention can be attained.

Experiment 1

(Evaluation of Production Stability of Film)

Figure 6:
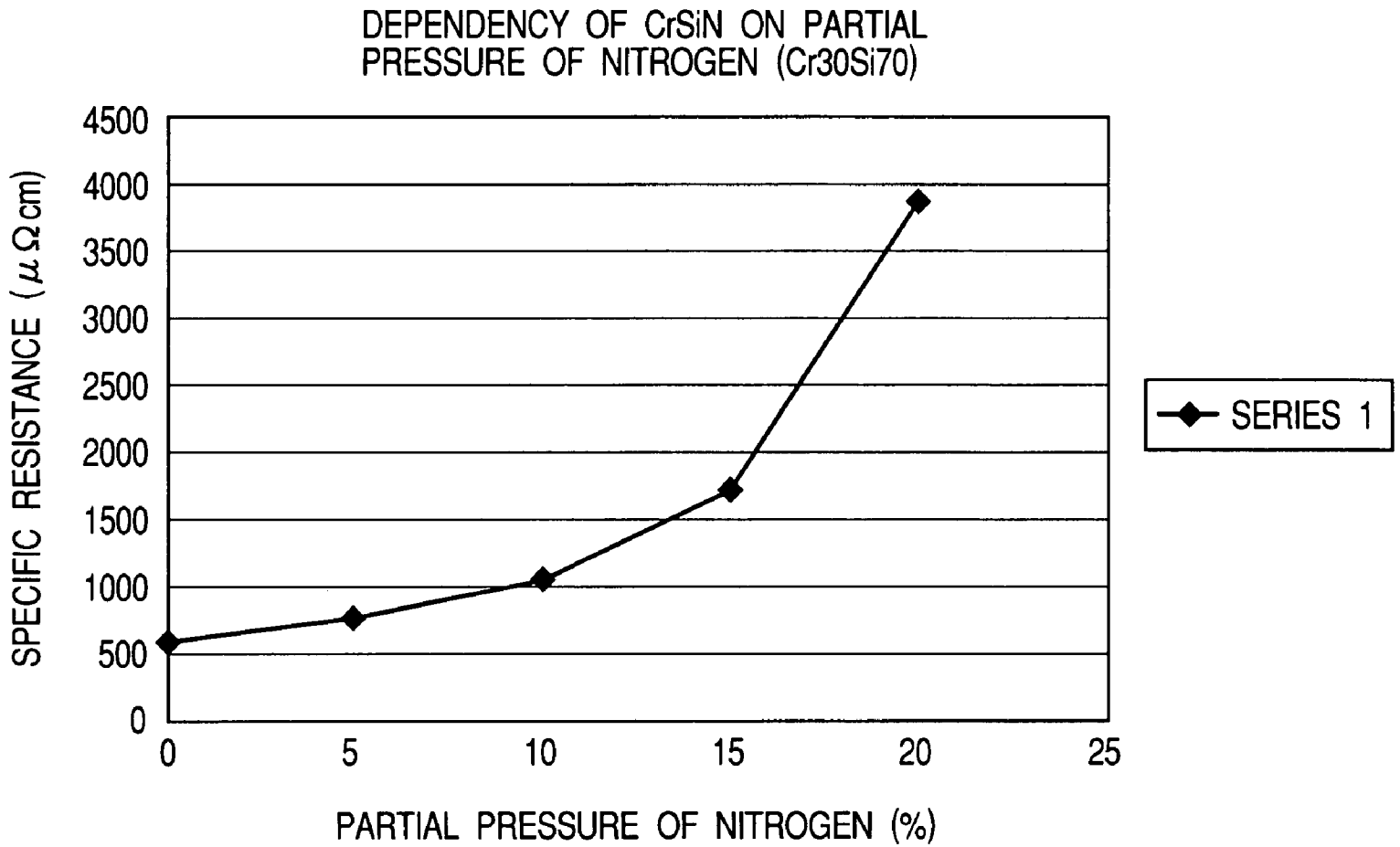
FIG. 6 is a chart showing a specific resistivity as a function of a partial nitrogen pressure in a resistor layer constituting a CrSiN heat generating resistant element layer.

An evaluation was made on the production stability of a CrSiN film. Film formations were conducted by varying a nitrogen partial pressure under main sputtering conditions with a target composition of $Cr_{30}Si_{70}$ (at. %), a power of 350 W and a gas pressure of 0.5 Pa, and there was determined a relationship between the nitrogen partial pressure and the specific resistivity (as to the sputtering apparatus, reference is to be made to FIG. 4). Results are shown in FIG. 6. As will be apparent from the chart, the specific resistivity is approximately proportional with the nitrogen partial pressure up to 0.15% (specific resistivity: up to about 1,700 μΩcm, and increases monotonously to a nitrogen partial pressure up to about 20%. Such relationship shows an increased margin in the variation of the nitrogen partial pressure for the specific resistivity, and indicates that the material is very excellent in terms of stability in a mass production.

The CrSiN film is disclosed, for example, in Japanese Patent Publication No. H2-18651, U.S. Pat. Nos. 4,392,992, 4,510,178, 4,591,821 etc., but these references do not teach nor suggest at all as to which atomic composition is useful as a heat generating resistant element for the electrothermal converting member of the ink jet head.

<Evaluation of Ink Jet Head Substrate>

Example 1

(Preparation of Substrate of Configuration Shown in FIG. 2)

At first, on a silicon substrate 2001, a heat accumulation layer 2002 of a thickness of 1.8 μm was formed by thermal oxidation, and an $SiO_2$ film, as an interlayer film 2003 serving also as a heat accumulation layer, was formed with a thickness of 1.2 μm by plasma CVD. Then, with the apparatus shown in FIG. 4, a CrSiN film was formed with a thickness of 400 Å as a heat generating resistant element layer 2004.

This operation was executed with gas flow rates of Ar gas: 64 sccm, and $N_2$ gas: 20 sccm, a power of 350 W charged to the target $Cr_{30}Si_{70}$, an atmospheric temperature of 200° C. and a substrate temperature of 200° C. Also as a metal wiring 2005 for heating the heat generating resistant element layer 2004 in the heat action surface 2008, an Al—Cu film was formed by sputtering with a thickness of 5,500 Å.

It was then patterned by a photolithographic process to form a heat action surface 2008 of 15×40 μm (planar size) where the Al—Cu layer was eliminated. As a protective film 2006, an SiN film was formed with a thickness of 1 μm by plasma CVD. In the present example, the substrate was maintained at 400° C. for about 1 hour also for heat treatment. Finally, as an anticavitation layer 2007, a Ta film was formed with a thickness of 2,000 Å by sputtering, thereby completing the substrate of the present invention. The heat generating resistant element layer of the aforementioned configuration had a sheet resistance of 910 Ω□. The TCR characteristics were about 40 ppm/° C.

Also in an RBS composition analysis, the CrSiN had a composition ratio of Cr: 20 at. %, Si: 42 at. % and N: 38 at. % (RBS is a common quantitative analysis for a film composition and means Rutherford back scattering).

Comparative Example 1

A substrate of Comparative Example 1 was obtained in the same manner as in Example 1, except that the heat generating resistant element layer 2004 was changed in a following manner. In the apparatus shown in FIG. 4, a binary simultaneous sputtering was executed with Ta and Si targets to form a TaSiN film a thickness of 1,000 Å. This operation was executed with gas flow rates of Ar gas: 45 sccm, and $N_2$ gas: 15 sccm, a nitrogen gas partial pressure of 25%, a power of 500 W charged to the Ta target, a power of 150 W charged to the Si target, an atmospheric temperature of 200° C. and a substrate temperature of 200° C. The heat generating resistant element layer had a sheet resistance of 270 Å/□.

Evaluation was made on following items, on the substrates obtained in Example 1 and Comparative Example 1.

A bubble generating voltage Vth for ink discharge was determined with the substrates prepared in Example 1 and Comparative Example 1. Also a current was measured in a drive employing a driving voltage of 1.2 Vth (1.2 times of the bubble generating voltage Vth) and a driving pulse width of 2 μsec.

Example 1 provided Vth=36 V and a current of 16 mA, while Comparative Example 1 provided Vth=24 V and a current of 35 mA.

In the comparison of the substrates of Example 1 and Comparative Example 1 of the present invention based on these results, the current was about ½ in comparison with that in Comparative Example. In an actual head, since there are plural heat generating resistant elements to be driven at the same time, the electric power consumption becomes far smaller than in Comparative Example, thus providing an energy saving effect.

(Durability)

Also an evaluation was made on durability against thermal stress by breaking pulses, by driving the heat generating resistant element under following conditions.

Principal Test-Conditions:

Drive frequency: 15 kHz, drive pulse width: 1 μsec, drive voltage: bubble generating voltage×1.2. As a result, Example 1 and Comparative Example 1 did not show breakage up to 4.0×E9 ($4.0\times10^9$) pulses. These results indicate that the substrate embodying the present invention can sufficient withstand the short pulse drive.

Also a similar evaluation was made on Comparative Example 2 prepared in the following manner.

A substrate of Comparative Example 2 was obtained in the same manner as in Example 1, except that the heat generating resistant element layer 2004 was changed in a following manner. In the apparatus shown in FIG. 4, a binary simultaneous sputtering was executed with Ta and Si targets to form a TaSiN film a thickness of 1,000 Å. This operation was executed with gas flow rates of Ar gas: 42 sccm, and $N_2$ gas: 18 sccm, a nitrogen gas partial pressure of 30%, a power of 400 W charged to the Ta target, a power of 50 to 200 W charged to the Si target, an atmospheric temperature of 200° C. and a substrate temperature of 200° C. Also in an RBS composition analysis, the CrSiN had a composition ratio of Ta: 32 at. %, Si: 6 at. % and N: 62 at. %. The heat generating resistant element layer in Comparative Example 2 had a specific resistivity ρ of 9,800 μΩcm.

The thus prepared substrate of Comparative Example 2 showed a breakage far before 4.0×E9 ($4.0\times10^9$) pulses, thus indicating an insufficient durability though the resistance was sufficient.

In the present invention, as a CrSiN film having a high resistance and a stability in resistance, the heat generating resistant element film is constituted of Cr, Si and N with a following composition:

Cr: 15 to 20 at. %,
Si: 40 to 60 at. % and
N: 20 to 45 at. % which constitute 100 at. %.

It is estimated that the durability becomes insufficient in case Cr<15 at. % and N>45 at. %, and the resistance becomes insufficient in case Cr>20 at. %, Si>60 at. % and N<20 at. %.

Following evaluation was conducted in order to confirm these points.

<Evaluation of characteristics for Ink Jet>

Also in order to evaluate the characteristics as a heat generating resistant element for a substrate for an ink jet recording head, there were prepared ink jet recording heads having a CrSiN film formed by the film forming method as in the foregoing example with the apparatus shown in FIG. 4 under film forming conditions of Examples 1 and 2 and with another film forming condition, and provided with an ink flow path formed in a position corresponding to each heat generating resistant element of the substrate of the structure shown in FIGS. 1 and 2, and characteristics of such heads were evaluated.

A substrate of a sample for the evaluation of the ink jet characteristics in the present example was an Si substrate as in Example 1, or an Si substrate in which a driving IC was already prepared therein.

In case of the Si substrate, an $SiO_2$ heat accumulating layer 2002 (FIG. 2) of a thickness of 1.8 μm by thermal oxidation, sputtering or CVD, and, in case of the Si substrate incorporating IC, an $SiO_2$ heat accumulating layer was formed in a preparing process.

Then an interlayer insulation film 2003 of $Sio_2$ with a thickness of 1.2 μm was formed by sputtering or CVD. Then a heat generating resistant element layer 2004 was formed by sputtering with a CrSi target. There were employed a power of 350 W charged into the target, gas flow rates of the conditions of Example 1 and a substrate temperature of 200° C.

Then, as an electrode wiring 2005, an Al—Si film was formed of 5,500 Å by sputtering. Then it was patterned by a photolithographic process to form a heat action portion 2008 of 20×20 μm where the Al—Si film was eliminated. Then, as a protective film 2006, a SiN insulator of a thickness of 1 μm was formed by plasma CVD. Also in this case, the substrate:temperature was maintained at 400° C. for about 1 hour as heat treatment. Then, as an anticavitation layer 2007, a Ta film was formed with a thickness of 2,300 Å by sputtering, and an ink jet substrate of the present invention as shown in FIG. 1 was prepared by a photolithographic process.

A CST test was executed with thus prepared substrate.

Figure 5:
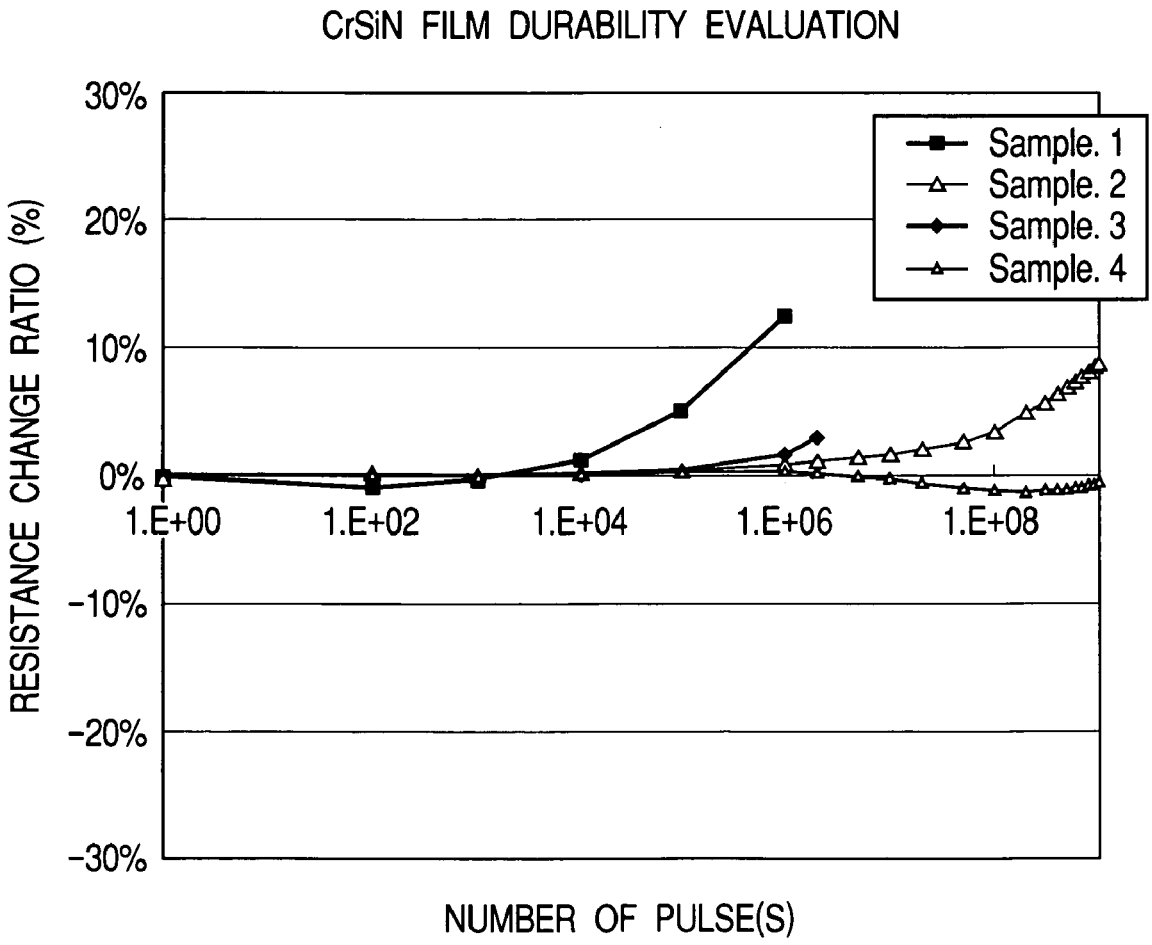
FIG. 5 is a chart showing results of a CST test in an example of the present invention and a comparative example.

FIG. 5 shows a resistance change rate in samples 1 to 4, when continuous pulses were applied with a driving voltage Vop=1.4 Vth in purified water, a drive frequency of 15 kHz, a drive pulse width of 1 μsec and a pulse number of $1.0\times10^9$ pulses.

CST Evaluation

Sample 1: $Cr_{14}Ai_{51}N_{35}$ (target composition ratio: Cr/Si=22.5/77.5, specific resistivity: 4,500 μΩcm);

Sample 2: $Cr_{17}Ai_{47}N_{36}$ (target composition ratio: Cr/Si=27.5/72.5, specific resistivity: 4,500 μΩcm);

Sample 3: $Cr_{22}Ai_{58}N_{20}$ (target composition ratio: Cr/Si=30.0/70.0, specific resistivity: 1,400 μΩcm);

Sample 4: $Cr_{18}Ai_{50}N_{32}$ (target composition ratio: Cr/Si=27.5/72.5, specific resistivity: 3,000 μΩcm).

As will be apparent from FIG. 5, the samples 2 and 4 corresponding to the examples of the present invention showed a resistance change of 10% or less at $1.0\times10^9$ pulses, but the samples 1 and 3 corresponding to the comparative examples of the present invention showed breakage before $1.0\times10^9$ pulses, thus indicating an insufficient durability.

A CST test was executed similarly on samples with following composition ratios obtained by suitable conditional changes.

Sample 5: $Cr_{18}Ai_{42}N_{40}$ (ρ: 4,500 μΩcm);

Sample 6: $Cr_{20}Ai_{42}N_{38}$ (ρ: 4,100 μΩcm);

Sample 7: $Cr_{17}Ai_{55}N_{28}$ (ρ: 2,200 μΩcm);

Sample 8: Cr: 22, Si: 5 2, N: 26% (target composition ratio:Cr/Si=30.0/70.0, ρ: 1,200 μΩcm);

Sample 9: Cr: 23, Si: 62, N: 15% (target composition ratio:Cr/Si=27.5/72.5, ρ: 1,500 μΩcm);

Sample 10: Cr: 15, Si: 40, N: 45% (target composition ratio: Cr/Si=27.5/72.5, ρ: 6,000 μΩcm).

As a result, the samples 5, 6 and 7 corresponding to the examples of the present invention showed a sufficient resistance and a resistance change rate of 10% or less at $1.0\times10^9$ pulses.

On the other hand, the samples 8 and 9 did not have a desired resistance, and showed breakage before $1.0\times10^9$ pulses. The sample 10 had a desired resistance, but showed breakage before $1.0\times10^9$ pulses, thus indicating an insufficient durability.

What is claimed is:

1. An ink jet head which comprises discharging ink utilizing thermal energy generated by a heat generating resistant element film constituted of Cr, Si and N having a following composition:

Cr: 17 to 20 atomic %,

Si: 42 to 55 atomic % and

N: 28 to 40 atomic %, which constitute 100 atomic % or substantially 100 at atomic %.

2. The ink jet head according to claim 1, wherein said heat generating resistant element film is constituted by Cr, Si and N within a range from 99.5 to 100 atomic % and a remainder is constituted by an impurity.

3. The ink jet head according to claim 3, wherein said heat generating resistant element film has a thickness within a range from 200 to 1,000 Å.

4. The ink jet head according to claim 5, wherein said heat generating resistant element film has a thickness within a range from 300 to 800 Å.

5. An ink jet apparatus comprising:

an ink jet head for discharging ink utilizing thermal energy generated by a heat generating resistant element film constituted of Cr, Si and N, having a following composition:

Cr: 17 to 20 atomic %,

Si: 42 to 55 atomic % and

N: 28 to 40 atomic %, which constitute 100 atomic % or substantially 100 atomic %; and a member for mounting said ink jet head.

6. An ink jet apparatus according to claim 5, wherein said heat generating resistant element film of the ink jet head is constituted by Cr, Si and N within a range from 99.5 to 100 atomic % and a remainder is constituted by an impurity.

* * * * *

UNITED STATES PATENT AND TRADEMARK OFFICE

CERTIFICATE OF CORRECTION

PATENT NO. : 7,055,937 B2
APPLICATION NO. : 10/745607
DATED : June 6, 2006
INVENTOR(S) : Hiroyuki Suzuki et al.

It is certified that error appears in the above-identified patent and that said Letters Patent is hereby corrected as shown below:

COLUMN 1:

Line 38, "U.S. Pat. No. 4,740,796." should read --U.S. Pat. No. 4,740,796).--.

COLUMN 5:

Line 7, "8.00Å." should read --800 Å.-- and "converging" should read --converting--.

COLUMN 6:

Line 34, "element" should read --elements--.

COLUMN 8:

Line 17, "is" should be deleted.

COLUMN 9:

Line 9, "width" should read --width of--.

COLUMN 13:

Line 4, "film" should read --film with--;
Line 10, "270Å/□." should read --270Ω/□.--;
Line 11, "following" should read --the following--;
Line 33, "following" should read --the following--;
Line 41, "sufficient" should read --sufficiently--; and
Line 49, "film" should read --film with--.

COLUMN 14:

Line 33, "$Sio_2$" should read --$SiO_2$--.

COLUMN 15:

Line 13, "Si: 5 2," should read --Si: 52,--.

UNITED STATES PATENT AND TRADEMARK OFFICE

CERTIFICATE OF CORRECTION

PATENT NO. : 7,055,937 B2
APPLICATION NO. : 10/745607
DATED : June 6, 2006
INVENTOR(S) : Hiroyuki Suzuki et al.

It is certified that error appears in the above-identified patent and that said Letters Patent is hereby corrected as shown below:

COLUMN 16:

Line 4, "at" should be deleted; and
Line 13, "claim 5," should read --claim 3,--.

Signed and Sealed this

Twenty-third Day of January, 2007

JON W. DUDAS
*Director of the United States Patent and Trademark Office*